United States Patent [19]

Kobayashi

[11] 4,420,151

[45] Dec. 13, 1983

[54] OVERLAPPING FEED DETECTION DEVICE IN SHEET-PROCESSING MACHINE

[75] Inventor: Tetsuji Kobayashi, Himeji, Japan

[73] Assignee: Glory Kogyo Kabushiki Kaisha, Hyogo, Japan

[21] Appl. No.: 293,261

[22] Filed: Aug. 17, 1981

[51] Int. Cl.[3] ..... B65H 7/12

[52] U.S. Cl. ..... 271/263; 209/603; 271/274; 340/675

[58] Field of Search ..... 271/263, 262, 274, 273, 271/125; 209/603, 604, 534; 340/674, 675; 270/56; 250/231 R; 200/61.41

[56] References Cited

U.S. PATENT DOCUMENTS

| | | | |
|---|---|---|---|
| 567,262 | 9/1896 | Child | 271/263 X |
| 2,129,230 | 9/1938 | O'Neil | 271/263 X |
| 3,130,394 | 4/1964 | Hinz et al. | 271/258 X |
| 3,354,273 | 11/1967 | Bleiman | 271/263 X |
| 4,008,891 | 2/1977 | Buys | 271/263 |
| 4,050,690 | 9/1977 | Michelson | 271/125 |
| 4,203,586 | 5/1980 | Hoyer | 271/263 X |

*Primary Examiner*—Bruce H. Stoner, Jr.
*Attorney, Agent, or Firm*—Wenderoth, Lind & Ponack

[57] ABSTRACT

An overlapping feed detection device in a machine for processing paper, money, slips, checks, or like sheets has propelling rolls driven by a motive power source and operating to propel the sheets and driven rolls disposed movably and spaced by a gate gap from the propelling rolls. The gate gap is for passage therethrough normally of a single sheet at one time. A holding mechanism holds the driven rolls in a nonrotatable state when one sheet passes through the gap, and release it to permit it to rotate when two or more sheets in overlapping state pass therethrough and widen the gap. A rotation detecting device detects the rotation of a rotatable structure.

5 Claims, 6 Drawing Figures

OVERLAPPING FEED DETECTION DEVICE IN SHEET-PROCESSING MACHINE

BACKGROUND OF THE INVENTION

This invention relates generally to machines and devices for handling paper money or bills, slips, chits, checks, and other sheet articles (hereinafter referred to as "sheets"). More particularly, the invention relates to an overlapping feed detection device for detecting the state of two or more sheets being fed or conveyed in mutually superposed or overlapped relation in a sheet-processing machine.

Among sheet-processing machines, there are those, such as a sheet dispensing machine, in which sheets are taken out, one sheet at a time, from a sheet storing section for receiving and storing sheets at a specific place, and, after a specific number of sheets thus taken out have been counted, these sheets are dispensed or otherwise sent out. When, in a machine of this character, two or more sheets in mutually overlapping state are taken out of the storing section, it is necessary to detect this overlapping state and prevent feeding or conveying of sheets in such overlapping state.

For this purpose, various kinds of overlapping feed detection devices in sheet processing machines of the above described character have heretofore been proposed, and some have been reduced to practice. In general, almost all of these known devices are of the type wherein one of two rolls for clamping sheets passed therebetween is supported in a manner to permit it to separate from and contact the other roll and is urged by a spring to press it against the other roll, and, when sheets are sent in an overlapping state of two or more sheets between these rolls, the spring-biased roll is forced to separate excessively from the other roll, this excessive separation being detected by a detector such as a microswitch.

In a known detection device of this type, however, excessive separating and contacting movements of the spring-biased roll due to extraneous causes even when there is no overlapping are detected directly by the detector as an indication of overlapping or are transmitted as vibration to the contacts of the microswitch. For this reason, or because of lagging of the instants of ON-OFF operations of the microswitch due to bouncing of the spring-biased roll at the time when even a single sheet is caught between or released by the rolls, a vibratory disturbance occurs in the detection signal transmitted from the microswitch. That is, a so-called waveform-breaking or switch-chattering phenomenon develops and gives rise to an unstable detection operation of the device, which has heretofore been a difficult problem.

Furthermore, because of the above described causes, a difference occurs between the actual value and the signal value of the length of the overlapped parts, whereby it has been difficult to determine the true length of overlap.

As a consequence of the unstable operation due to these causes, in the case of an after treatment of sheets fed in overlapping state such as, for example, rejection, sheets of a number which is greater than that necessary are unavoidably rejected. This has led to a great drop in performance in the sheet-processing operation.

SUMMARY OF THE INVENTION

It is an object of this invention to provide an overlapping feed detection device in a sheet-processing machine, which device is capable of positively detecting overlapping of sheets being conveyed, thereby to assure accurate and positive processing of the sheets and to eliminate unnecessary rejection of sheets.

According to this invention, briefly summarized, there is provided an overlapping feed detection device in a machine for processing paper money, slips, checks, or like sheets, which detection device comprises: a conveying belt, propelling rolls or like propelling means driven by motive power means and operating to successively propel the sheets; a driven rotatable structure rotatably supported to parallelly confront the propelling means and to be separable therefrom and approachable thereto, a gate gap being formed between the propelling means and the driven rotatable structure for passage therethrough normally of a single sheet at one time, the gap being widened when two or more sheets in overlapping state pass therethrough to force the driven rotatable structure to undergo a displacement away from the propelling means; and detecting means for detecting such displacement thereby to detect the overlapping feed of the sheets, and is characterized by a holding mechanism for holding the driven rotatable structure in unrotatable state when the gate gap is formed and for releasing the driven rotatable structure when the rotatable structure is forced to undergo such displacement by the passage of two or more sheets in overlapping state and thereby undergo rotation, and a rotation detecting device for detecting rotation of the rotatable structure.

The nature, utility, and further features of this invention will be more clearly apparent from the following detailed description with respect to preferred embodiments of the invention when read in conjunction with the accompanying drawings, briefly described below.

DETAILED DESCRIPTION OF THE INVENTION

Figure 1:
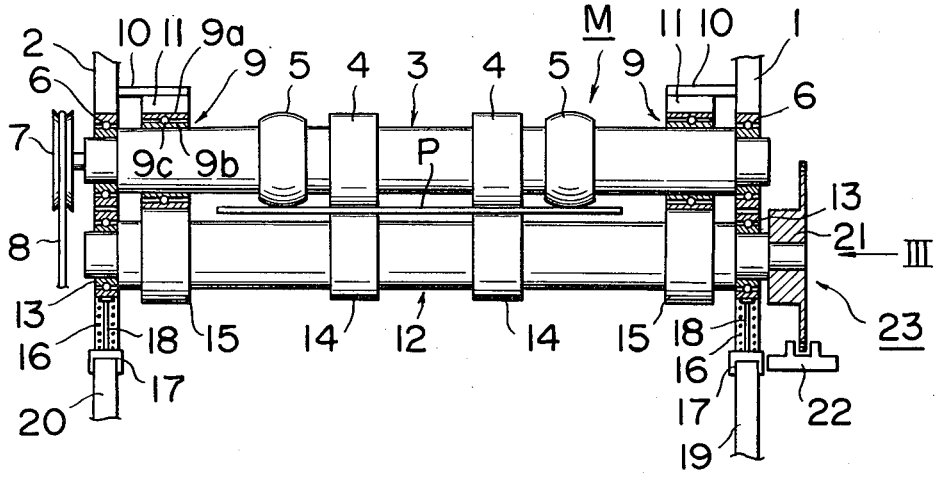
FIG. 1 is a view in the direction of sheet movement, with some parts shown in section, showing the essential parts of one example of the detection device according to this invention.

Referring first to FIG. 1, sheets P taken out one-by-one from a sheet storing section (not shown) are conveyed to an overlapping feed detection device M by a device such as a conveying belt (not shown).

This detection device M has a driving shaft 3 rotatably supported at its two ends by bearings 6, 6 on machine frame parts 1 and 2. At the middle part of this driving shaft 3, propelling rolls 4, 4 of the shape of rolls are formed integrally and coaxially with the shaft 3 at suitably spaced-apart positions. On both outer sides of these propelling rolls 4, 4, guide rings 5, 5 for guiding the two lateral sides of each sheet P are integrally formed with the driving shaft 3.

A driven pulley 7 is fixedly mounted on one end (the left-hand end as viewed in FIGS. 1 and 2) of the driving shaft 3, which extends out beyond the left bearing 6. This driven pulley 7 is driven by an endless driving belt 8 passed therearound and driven by a driving power source (not shown).

On the inner sides of the two bearings 6, 6, bearings 9, 9 are provided around the driving shaft 3. Each bearing 9 comprises an outer race 9*a*, an inner race 9*b*, and balls 9*c* interposed therebetween, the inner race 9*b* being coaxially fixed to the driving shaft 3. Each outer race 9*a* is prevented from rotating by a respective friction holding member 11 supported by a respective support arm 10 extending inward from the machine frame part 1 (or 2).

A driven shaft 12 is disposed parallelly to the driving shaft 3 and is rotatably supported at its two ends by bearings 13, 13 on machine frame parts 1 and 2. The bearings 13, 13 are so supported on the frame parts 1 and 2 that they can be separated from or moved toward respective bearings 6, 6.

The driven shaft 12 is provided with driven rolls 14, 14 formed integrally and coaxially therewith at spaced-apart positions in the axial direction to confront and be in register with the aforementioned propelling rolls 4, 4, respectively. Between each propelling roll 4 and its corresponding driven roll 14, a gate gap of a size such as to normally pass only a single sheet P is formed. The driven shaft 12 is further provided with pressing rollers 15, 15 disposed coaxially therewith at positions in the axial direction to confront and be in register with the aforementioned bearings 9, 9, respectively, on the driving shaft 3. These pressing rollers 15, 15 are in pressing contact with the outer surfaces of the outer races 9*a*, 9*a* of their respective bearings 9, 9.

Each of the bearings 13, 13 rotatably supporting the driven shaft 12 at its ends is supported on one end of a compression spring 16 and is pressed thereby toward the corresponding bearing 6, whereby the driven shaft 12 is continually urged by these compression springs 16, 16 to move toward the driving shaft 3. The other ends of the compression springs 16 are secured to respective support frames 17, 17 fixedly supported on machine frame parts 19 and 20. A screw 18 fixed at one end thereof to each support frame 17 extends partly through the corresponding compression spring 16 and serves to limit the compressive deflection thereof.

A detection disk 21 is fixed coaxially to the extreme right-hand end (as viewed in FIGS. 1 and 2) of the driven shaft 12, which extends outward beyond the right-hand bearing 13. For the purpose of detecting the quantity or number of rotations of the driven rolls 14, 14, this detection disk 21 is provided in a common circle near its outer periphery with numerous small through holes 21*a* formed at constant spacing intervals. The holes 21*a* are used in conjunction with a detector 22 to carry out detection as described hereinafter. Thus, the detection disk 21 and the detector 22 constitute a rotation detecting device 23.

In the instant example, the detector 22 comprises a photosensor, which is positioned at the outer periphery of the detection disk 21 and detects the passing by of the holes 21*a*, transmitting a detection signal in response thereto to a counting circuit.

Figure 2:
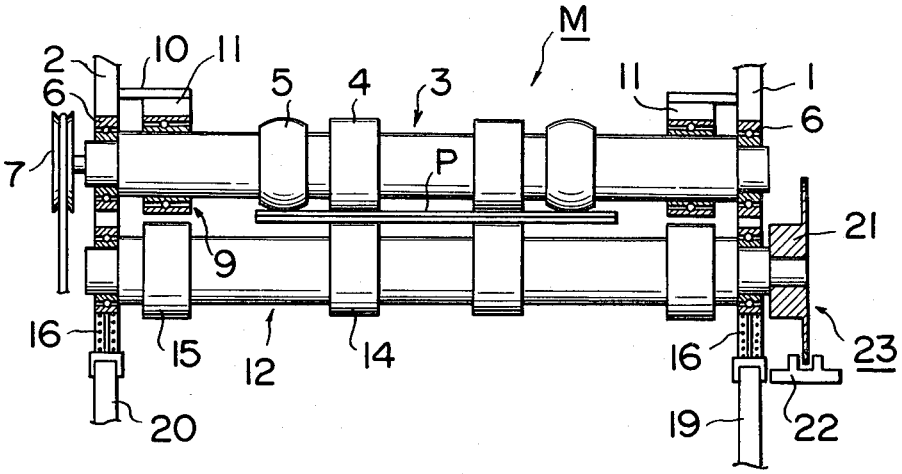
FIG. 2 is a similar view of the same device in a state wherein two sheets in an overlapping state have been fed thereinto.
Figure 3:
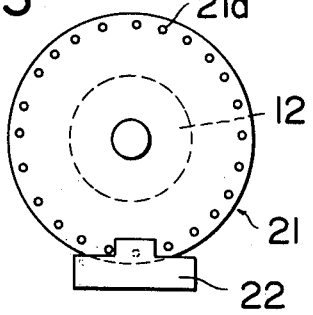
FIG. 3 is a side view in the arrow direction III in FIG. 1 of a detecting device.

While, in the example illustrated in FIGS. 1, 2, and 3, numerous holes 21*a* are provided in the detection disk 21, the detector 22 may be adapted to operate cooperatively with a magnetic rotational member, or the detection disk may be provided with light-reflecting members for detection of rotation by utilizing reflected light.

The example of the detection device of the above described construction according to this invention operates in the following manner.

Sheets P taken out one at a time from a sheet storing section (not shown) are successively fed by a conveyor belt or the like (also not shown) to the vicinity of the driving shaft 3. Then, since the driving shaft 3 is continually rotating, each sheet P passes through the gate gap between the propelling rolls 4, 4 and the driven rolls 14, 14 when the sheet P is not overlapped by another sheet. At this time, the pressing rollers 15, 15 of the driven shaft 12 are being caused by the compression springs 16, 16 to be in pressing contact with the outer races 9*a*, 9*a* of the bearings 9, 9. Moreover, since the outer races 9*a*, 9*a* are being held against rotation by the friction holding members 11, 11, the driven rolls 14, 14 do not rotate, and only one sheet passes through at one time in a normal manner.

When, as indicated in FIG. 2, two sheets P arrive in an overlapping state, the excessive thickness of the two sheets P causes the driven rolls 14, 14 to be pressed in a direction to separate from the propelling rolls 4, 4. Consequently, the pressing rollers 15, 15 separate away from the outer races 9*a*, 9*a* of the bearings 9, 9. At this time, the compression springs 16, 16 are under compression. For this reason, the rotation of the propelling rolls 4, 4 is transmitted by way of the sheets P to the driven rolls 14, 14, whereby the driven rolls 14, 14 rotate. As a consequence, the detector 22 of the rotation detecting device 23 detects the passing thereby of the holes 21*a* of the detection disk 21 and, in response thereto, sends a signal to the counting circuit, which counts the holes passing by the detector 22.

At the instant when the overlapping parts of the two sheets P pass completely through the space between the propelling rolls 4, 4 and the driven rolls 14, 14, the driven rolls 14, 14 are immediately returned by the springs 16, 16 to their normal state wherein the aforementioned gate gap for a single sheet is restored and maintained between them and the propelling rolls 4, 4. Simultaneously, the pressing rollers 15, 15 are immediately pressed against the corresponding outer races 9*a*, 9*a* of the bearings 9, 9 and are thereby immediately stopped. Consequently, the rotation of the detection disk 21 is stopped, and the counting of the holes 21*a* passing by the detector 22 is also stopped.

Thus, the length of the overlapping parts of the two sheets P can be detected directly from the number of holes 21*a* counted, and the resulting detection signal can be utilized in an after process for appropriate measures. Moreover, this detection can be accomplished without the occurrence of the problem of signal waveform breakage or switch chattering, whereby the reliability of the device as an overlapping feed detection device can be remarkably elevated, and the number of rejected sheets in the case of rejection of overlapping sheet can be reduced to a minimum. Accordingly, a sheet-processing machine provided with the detection device of this invention can be made to operate with high efficiency.

Figure 4:
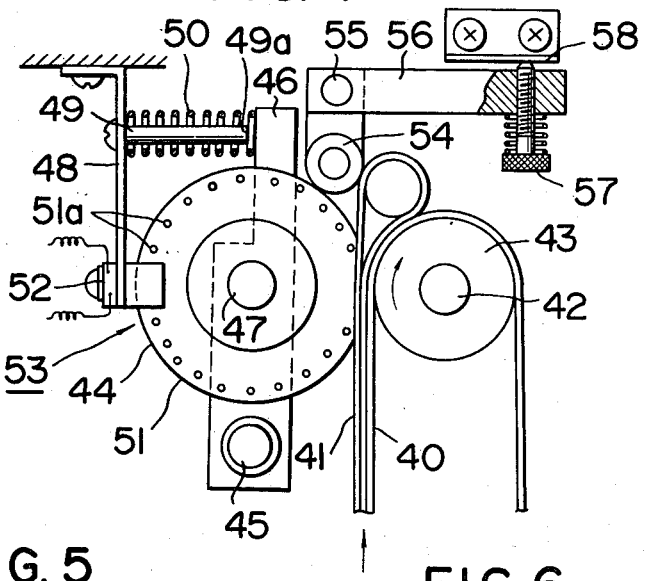
FIG. 4 is a side view, with some parts shown in section, showing the essential parts of another example of the detection device of the invention.
Figure 5:
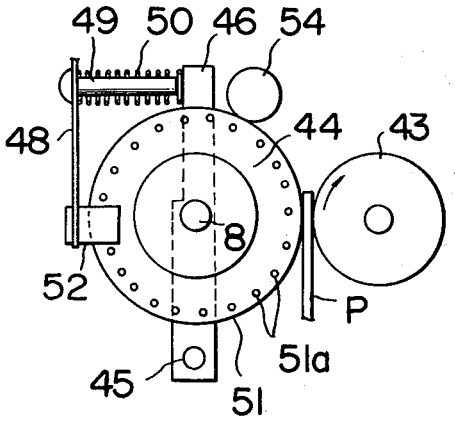
FIG. 5 is a simplified side view of the device shown in FIG. 4 in the normal sheet feeding state.
Figure 6:
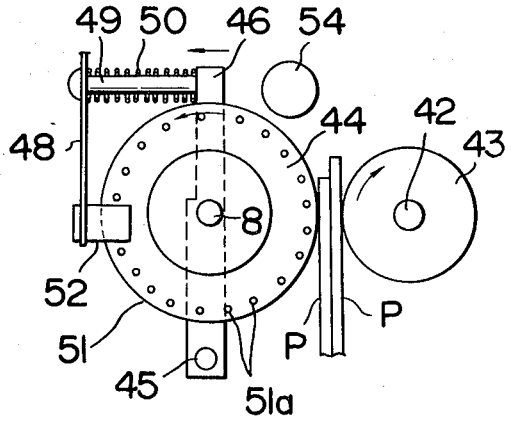
FIG. 6 is a simplified side view similar to FIG. 5 indicating the state of the device when two overlapping sheets have been fed thereinto.

In a modification of the above described detection device, as shown in FIGS. 4, 5, and 6, the conveying means for feeding sheets taken out one-by-one from a sheet storing section (not shown) comprises conveying belts 40 and 41. One conveying belt 40 is passed around a propelling roll 43 which is fixedly mounted on a pulley shaft 42 and so disposed relative to a driven roll 44 that their peripheral surfaces confront each other.

The driven roll 44 is rotatably mounted by a shaft 47 on a support member 46 at an intermediate part thereof. The support member 46 is essentially a lever which is pivotally supported at its one end by a pivot shaft 45 on a machine frame part (not shown) and is therefore free to swing about the pivot shaft 45. The driven roll 44 is continually urged to move toward the propelling roll 43 by a coil compression spring 50 in pressing contact at its one end (right-hand end as viewed in FIG. 4) against the other, free end of the support member 46 on the side thereof remote from the propelling roll 43. The other end of the compression spring 50 is in abutting contact against an intermediate part of a leaf spring 48 of cantilever type whose fixed end is fixed to a machine frame part.

The compression spring 50 is stably supported by a screw 49 fixed at its head end to the leaf spring 48 and extending partly through the interior of the coil spring 50 toward the free end of the support member 46. The screw 49 further functions as a member for limiting movement, its other, free end 49*a* limiting the compressive deflection of the compression spring 50 when the support member swings in the counterclockwise direction (as viewed in FIG. 4) through an angle in excess of a specific angle and causing the leaf spring 48 to deflect leftward.

On one side face of the above described driven roll 44, there is provided a detection disk 51 having numerous holes 51*a* disposed at specific spacing intervals on and around a common circle near the outer periphery of the detection disk 51 for the purpose of detecting the quantity (angle) of rotation thereof. These holes 51*a* function cooperatively with a detector 52 described hereinafter to constitute and operate as a rotation detecting device 53.

A stopping member 54 is normally in pressing contact against the outer peripheral surface of the driven roll 44 at the upper-right part thereof as viewed in FIG. 4. This stopping member 54, which is of the shape of a roller and is made of a material of large coefficient of friction, is fixedly supported on one end of an adjusting lever 56 pivotally supported at an intermediate part thereof by a pivot pin 55 on a machine frame part (not shown). The other end of the adjusting lever 56 is provided with an adjusting screw 57 screw-engaged therewith and having a tip in abutting contact with a datum surface 58 provided on a machine frame part. The head of the screw 57 is urged downwardly by a spring 57*a* to fix it in an adjusting position. The position of the stopping member 54 relative to the driven roll 44 is thus finely adjustable by the adjusting screw 57.

The stopping member 54 thus sets the approaching position of the driven roll 44 relative to the propelling roll 43. In this normal state of these parts, the stopping member 54 functions to stop the rotation of the driven roll 44 and to cause a gate gap for permitting the passage therethrough of only a single sheet P to be formed between the driven roll 44 and the propelling roll 43.

The second example of the detecting device of the above described construction according to this invention is adjusted and operates in the following manner.

First, in order to adjust the gap between the propelling roll 43 and the driven roll 44, a single sheet P to be processed is held therebetween by hand, and, by turning the adjusting screw 57, the adjusting lever 56 is rotated about its pivot pin 55 thereby to cause the stopping member 54 to be in pressing contact with the peripheral surface of the driven roll 44. In this manner, the gate gap between the propelling roll 43 and the driven roll 44 is adjusted to a value which is greater than the thickness of one sheet but less than that of two sheets to be processed.

Then, after the gate gap has been set in this manner, the sheets P taken out sheet-by-sheet from the sheet storing section (not shown) are conveyed in the arrow direction shown in FIG. 4 between the conveying belts 40 and 41. When the sheets P are thus arriving one-by-one, they pass normally through the gap between the propelling roll 43 and the driven roll 44 as shown in FIG. 5. During this normal operation, the driven roll 44 is not rotating because the stopping member 54 is in pressing contact therewith, and it may be considered that a single sheet is being passed at one time in the normal manner.

If two sheets P,P in overlapping state are fed into the gap between the two rolls 43 and 44 as shown in FIG. 6, the detection device will operate as follows. As a consequence of the excessive thickness of the overlapping sheets P,P, the driven roll 44 is pressed toward the left, as viewed in FIG. 6, away from the propelling roll 43, and the support member 46, on which the driven roll 44 is rotatably supported, is caused to swing in the counterclockwise direction about its pivot shaft 45 counter to the rightward force of the compression spring 50. Consequently, the driven roll 44 separates from the stopping member 54 and thereby assumes a freely rotatable state, being rotated in the arrow direction, or counterclockwise direction, in FIG. 6.

When the driven roll 44 thus rotates, the detector 52 of the rotation detecting device 53 detects the movement of the holes 51*a* of the detection disk 51 and transmits a corresponding detection signal to a counting circuit (not shown). The output of the counting circuit indicates the length of overlap of the two overlapping sheets P,P and is utilized in an after treatment.

In the above described operation, in cases such as that wherein the thickness of two overlapping sheets P,P sent into the gap between the two rolls 43 and 44 is large, or three or more sheets P are simultaneously thus sent, the distance of separation of the driven roll 44 becomes large, but in such a case, the free end of the support member 46 supporting the driven roll 44 comes into contact with the outer extremity 49*a* of the screw 49 for limiting movement which is in screw engagement with the leaf spring 48. Consequently, the leaf spring 48 deflects, whereby the mutual positional relationship between the driven roll 44 and the detector 52 mounted on the free end of the leaf spring 48 is continually maintained in a normal state.

While, in the example shown FIG. 1, two driven rolls 14, 14 are provided on the driven shaft, only one driven roll 14 may be alternatively provided on the shaft.

What is claimed is:

1. In an overlapping feed detection device for use in a machine for processing paper money, slips, checks, or like sheets, said detection device being of the type including propelling means driven by motive power means and operating to successively propel sheets to be processed, a driven rotatable structure rotatably supported to parallelly confront said propelling means and to be separable therefrom and approachable thereto, a gate gap being formed between said propelling means and said driven rotatable structure for passage therethrough normally of a single sheet at one time, said gap being widened when two or more sheets in overlapping state pass therethrough to force said driven rotatable structure to undergo a displacement away from said propelling means, and detecting means for detecting said displacement thereby to detect the overlapping feed of the sheets, the improvement comprising:

a driving shaft formed integrally and coaxially with said propelling means;

a driven shaft formed integrally and coaxially with said driven rotatable structure;

bearings including inner races fixedly mounted on said driving shaft to rotate unitarily therewith and outer races;

a holding mechanism including holding members normally holding said outer races against rotation;

pressing rollers formed integrally with said driven shaft and said driven rotatable structure;

elastic members urging said pressing rollers normally into pressing contact with said outer races;

whereby said gate gap for passing only a single sheet is formed between said propelling means and said driven rotatable structure when said pressing rollers are in pressing contact with said outer races, and said pressing contact prevents said pressing rollers, said driven shaft and said driven rotatable structure from rotating;

whereby, when two or more sheets in an overlapping state cause a widening of said gap and a displacement of said driven rotatable structure away from said propelling means, said pressing contact is released, thereby enabling rotation of said pressing rollers, said driven shaft and said driven rotatable structure; and rotation detecting means for detecting the rotation of said driven rotatable structure.

2. The improvement claimed in claim 1, wherein said rotation detecting means comprises a disk-shaped detection member fixedly and coaxially mounted on said driven shaft, and a detector for detecting the amount of rotation of said detection member.

3. The improvement claimed in claim 2, wherein a plurality of holes are formed in said detection member at constant spacing intervals around a common circle near the outer peripheral edge of said detection member, and said detector comprises a photosensor mounted at a position confronting the circle of said holes.

4. In an overlapping feed detection device for use in a machine for processing paper money, slips, checks, or like sheets, said detection device being of the type including propelling means driven by motive power means and operating to successively propel sheets to be processed, a driven rotatable structure rotatably supported to parallelly confront said propelling means and to be separable therefrom and approachable thereto, a gate gap being formed between said propelling means and said driven rotatable structure for passage therethrough normally of a single sheet at one time, said gap being widened when two or more sheets in overlapping state pass therethrough to force said driven rotatable structure to undergo a displacement away from said propelling means, and detecting means for detecting said displacement thereby to detect the overlapping feed of the sheets, the improvement comprising:

a support member pivotally supported at one end thereof;

said driven rotatable structure comprising a driven roll rotatably supported on said support member;

a holding mechanism including a stopping member;

elastic means for urging said support member to pivot in a direction to cause said driven roll normally to have a peripheral surface thereof be in pressing contact with said stopping member and thus to hold said driven roll in a non-rotatable condition;

the position of said stopping member being adjustable, thereby to adjust the size of said gap between said propelling means and said driven roll;

whereby, when two or more sheets in an overlapping state cause a widening of said gap and a displacement of said driven roll away from said propelling means, said pressing contact is released, thereby enabling rotation of said driven roll; and detector means mounted to confront an outer peripheral part of said driven roll for detecting the amount of rotation thereof.

5. The improvement claimed in claim 4, wherein said elastic means and said detector means are secured to an elastically deflectable member, and further comprising movement limiting means, secured to said elastically deflectable member, for, when said driven roll separates from said stopping member thereby to cause said support member to elastically deform said elastic means, contacting said support member thereby to limit the deformation of said elastic means, and, when said driven roll separates further from said stopping member, being pushed by said support member to cause deflection of said elastically deflectable member thereby to cause said detector means to undergo a displacement for compensating for the displacement of said driven roll.

* * * * *